US005801118A

United States Patent [19]

Bowman et al.

[11] Patent Number: 5,801,118

[45] Date of Patent: Sep. 1, 1998

[54] RELEASE AGENT FOR DYE-DONOR ELEMENT USED IN THERMAL DYE TRANSFER

[75] Inventors: Wayne A. Bowman, Walworth; Karen M. Kosydar, Penfield, both of N.Y.

[73] Assignee: Eastman Kodak Company, Rochester, N.Y.

[21] Appl. No.: 879,063

[22] Filed: Jun. 19, 1997

[51] Int. Cl.[6] ..... B41M 5/035; B41M 5/38

[52] U.S. Cl. ..... 503/227; 428/195; 428/421; 428/422; 428/913; 428/914

[58] Field of Search ..... 8/471; 428/195, 428/913, 914, 421, 422; 503/227

[56] References Cited

U.S. PATENT DOCUMENTS

| | | | |
|---|---|---|---|
| 4,740,496 | 4/1988 | Vanier | 503/227 |
| 5,223,474 | 6/1993 | Usui | 503/227 |

FOREIGN PATENT DOCUMENTS

| | | | |
|---|---|---|---|
| 04/022686 | 1/1992 | Japan | 503/227 |

*Primary Examiner*—Bruce H. Hess

*Attorney, Agent, or Firm*—Harold E. Cole

[57] ABSTRACT

This invention relates to a dye-donor element for thermal dye transfer comprising a support having thereon a dye layer comprising an image dye in a polymeric binder, and wherein the dye layer also containing a release agent comprising a copolymer having the following formula:

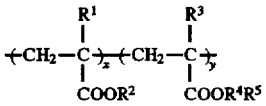

wherein $R^1$ and $R^3$ each independently represents hydrogen or methyl;

$R^2$ represents a substituted or unsubstituted alkyl group of from 1 to about 6 carbon atoms;

$R^4$ represents a divalent bridging group having from 1 to about 16 carbon atoms;

$R^5$ represents a haloalkyl group having from about 3 to about 20 carbon atoms, wherein the halogen consists essentially of fluorine;

x represents 25–95 weight percent; and y represents 5–75 weight percent.

19 Claims, No Drawings

RELEASE AGENT FOR DYE-DONOR ELEMENT USED IN THERMAL DYE TRANSFER

FIELD OF THE INVENTION

This invention relates to the use of certain release agents in dye-donor elements for thermal dye transfer systems.

Background of the Invention

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Upon completion of the dye transfer, the dye-donor element should separate cleanly from the dye-receiving element to give an acceptable print. A problem exists with many of the dye-donor and dye-receiving elements in that at the high temperatures used for thermal dye transfer, many of the polymers used in these elements soften and adhere to the elements, resulting in sticking and tearing of the latter upon separation.

2. Description of the Related Art

U.S. Pat. No. 4,740,496 and JP 04/022,686 relates to the use of monomeric and short chain oligomeric acrylates containing perfluoroalkyl side chains in a dye-donor element. Although effective in preventing adhesion between a dye-donor element and a dye-receiving element, there is a problem with using such small mobile compounds in that they can promote dye mobility in the dye-donor layer leading to dye crystallization or dye build-up on the dye-donor. Such dye-donor elements may then undergo transfer of dye to the dye-receiving element without the application of heat, which results in an objectionable color density appearing in an area of the print which should be without color.

U.S. Pat. No. 5,223,474 relates to using higher molecular weight fluoro-chloro alkyl acrylates in a dye-donor element to increase friction. However, there is a problem with using these compounds in that they are expensive, difficult to prepare and are unstable. In addition, without proper stabilization, chloroalkyl polymers are known to have acidic thermal degradation products which would be potentially harmful to dyes.

It is an object of this invention to provide a dye-donor element which contains a release agent which is effective in reducing the adhesion of the dye-donor to the dye-receiver after printing. It is another object of this invention to provide a dye-donor element which contains a release agent which reduces the interaction with dyes that leads to pressure-induced dye transfer to the receiving element, i.e., objectionably high Dmin.

SUMMARY OF THE INVENTION

These and other objects are achieved in accordance with this invention which relates to a dye-donor element for thermal dye transfer comprising a support having thereon a dye layer comprising an image dye in a polymeric binder, the dye layer also containing a release agent comprising a copolymer from the class having the following formula:

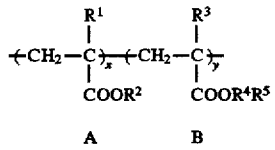

wherein $R^1$ and $R^3$ each independently represents hydrogen or methyl;

$R^2$ represents a substituted or unsubstituted alkyl group of from 1 to about 6 carbon atoms;

$R^4$ represents a divalent bridging group having from 1 to about 16 carbon atoms;

$R^5$ represents a haloalkyl group having from about 3 to about 20 carbon atoms, wherein the halogen consists essentially of fluorine;

x represents 25–95 weight percent; and y represents 5–75 weight percent.

DESCRIPTION OF THE PREFERRED EMBODIMENTS

By using the release agents of the present invention in dye-donor elements, there is a reduction of the adhesion of the dye-donor to the dye-receiver after printing, and the interaction with dyes that leads to pressure-induced dye transfer to the receiving element, i.e., objectionably high Dmin, is also reduced.

In a preferred embodiment of the invention, x represents 50–90 weight percent and y represents 10–50 weight percent.

The release agents may be used in the invention in any amount which is effective for the intended purpose. In general, good results have been obtained when the release agent is present at a concentration of from about 2 to about 40% by weight of the dye layer. In a preferred embodiment, the release agent is present at a concentration of from about 5 to about 15% by weight of the dye layer.

In another preferred embodiment, $R^1$ and $R^3$ each represent methyl. In still another preferred embodiment, $R^2$ represents butyl, and $R^4$ represents a bridging group such as $—CH_2—$, $—C_3H_6$, $—C_4H_8$, etc., preferably $—C_2H_4—$. In yet still another preferred embodiment, $R^5$ represents a perfluoro group having from 6 to 12 carbon atoms.

Examples of B, which are fluoroalkyl acrylate or methacrylate monomers, useful for this invention include DuPont Zonyl® fluorochemical intermediates as shown in the following table. Each Zonyl® material contains a mixture of compounds wherein the fluoroalkyl groups, $R^5$, have a range of chain lengths (for example, C6 to C-12).

TABLE 1

| Zonyl ® | Composition |
|---|---|
| TA-N Fluoroalkyl acrylate | $R^5CH_2CH_2OOCC(H)=CH_2$ |
| TM Fluoroalkyl methacrylate | $R^5CH_2CH_2OOCC(CH_3)=CH_2$ |

TABLE 2

| Copolymer | MONOMER A (wt. %) | MONOMER B (wt. %) |
|---|---|---|
| A-1 | butyl methacrylate (50) | Zonyl ® TM (50) |
| A-2 | methyl methacrylate (50) | Zonyl ® TM (50) |
| A-3 | butyl methacrylate (75) | Zonyl ® TM (25) |
| A-4 | butyl methacrylate (85) | Zonyl ® TM (15) |

Any dye can be used in the dye-donor employed in the invention provided it is transferable to the dye-receiving layer by the action of heat. Especially good results have been obtained with sublimable dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicaryl Blue 6G® (product of Sumitomo Chemical Co., Ltd.), and Aizen Malachite Green® (product of Hodogaya Chemical Co., Ltd.);

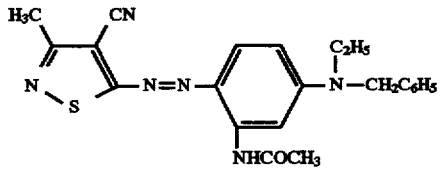

Magenta Dye M-1

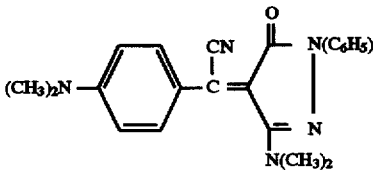

Magenta Dye M-2

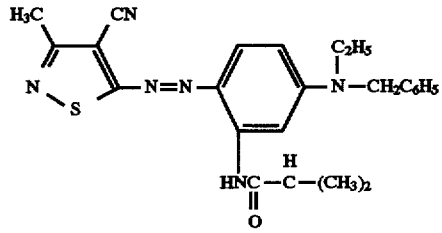

Magenta Dye M-3

-continued

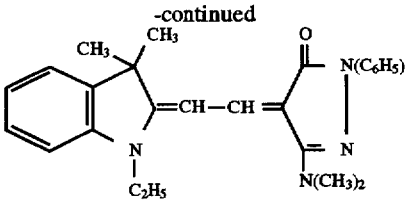

Yellow Dye Y-1

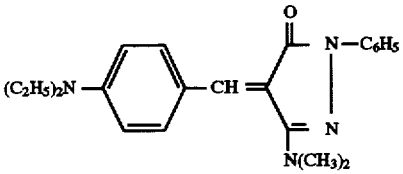

Yellow Dye Y-2

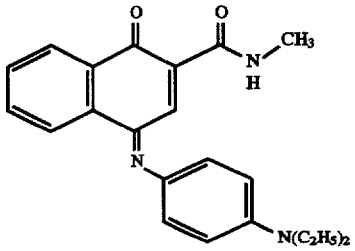

Cyan Dye C-1

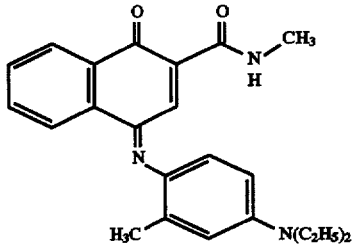

Cyan Dye C-2

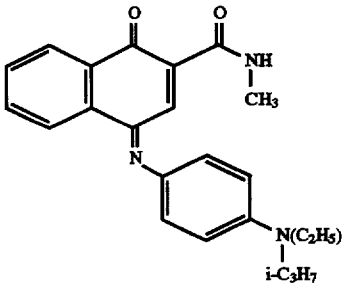

Cyan Dye C-3 or any of the dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. The above dyes may be employed singly or in combination. The dyes may be used at a coverage of from about 0.05 to about 1 $g/^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element of the invention provided it is dimensionally stable and can withstand the heat of the thermal head. Such materials include polyesters such as poly(ethylene terephthalate); polyamides; polycarbonates; cellulose esters such as cellulose acetate; fluorine polymers such as poly (vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 μm. It may also be coated with a subbing layer, if desired, such as those materials described in U.S. Pat. No. 4,695,288 or 4,737,486.

The dye in the dye-donor element of the invention is dispersed in polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; poly(vinyl acetate), poly (vinyl acetal), poly(vinyl butyral), poly(styrene-co-acrylonitrile), a polysulfone, a poly(phenylene oxide) or a phenoxy resin. The binder may be used at a coverage of from about 0.1 to about 5 $g/m^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The dye image-receiving layer may comprise, for example, a polycarbonate, a polyurethane, a polyester, a polyacrylate, poly(vinyl chloride), poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 $g/m^2$.

As noted above, the dye-donor elements of the invention are used to form a dye transfer image. Such a process comprises imagewise heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color element (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089, or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention:

EXAMPLES

Example 1

Comparative test with materials of U.S. Pat. No. 4,740,496

The following dyes were employed in the examples:

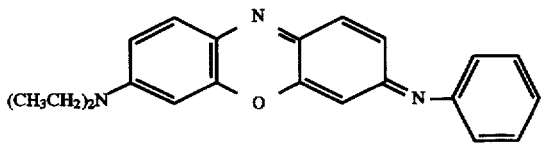

Dye D-1

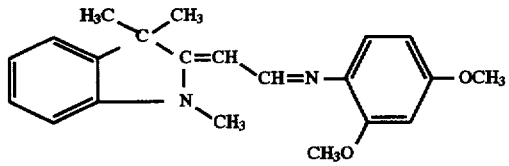

Dye D-2

Preparation of Dye-Donor Elements

Individual dye-donor elements were prepared by coating on 6 μm poly(ethylene terephthalate) support the following layers:

1) a subbing layer of Tyzor TBT®, a titanium tetrabutoxide, (DuPont Company) (0.13 g/m$^2$) coated from a 15:85 wt-% blend of 1-butanol and propyl acetate; and
2) a dye layer containing, D-1 described above (0.15 g/m$^2$) and the fluoroalkyl acrylate copolymer A-1, in a cellulose acetate propionate binder (1:1 wt-% blend of CAP-482-0.5 (a 0.5 s viscosity cellulose acetate propionate from Eastman Chemical Company), and CAP-482-20, (a 20 s viscosity cellulose acetate propionate from Eastman Chemical Company) coated from a 95:5 wt-% tetrahydrofuran/cyclopentanone mixture. Details of the component laydowns are listed in Table 3 below.

On the backside of the dye-donor element were coated:

1) a subbing layer of Tyzor TBT®, (0.13 g/m$^2$) coated from a 15:85 wt-% blend of 1-butanol and propyl acetate: and
2) a slipping layer of poly(vinyl acetal) (Sekisui Kagaku KK) (0.38 g/m$^2$), a Candelilla wax dispersion (7% in methanol) (0.022 g/m$^2$), PS513, an amino-terminated polydimethyl-siloxane, (Huels) (0.011 g/m$^2$), and p-toluenesulfonic acid (0.0003 g/m$^2$) coated from a 98:2 wt-% 3-pentanone/distilled water mixture.

TABLE 3

| Dye Donor Element | CAP Binder (g/m$^2$) | Release Agent A-1 (g/m$^2$) |
|---|---|---|
| 1 | 0.215 | 0.011 |
| 2 | 0.203 | 0.023 |
| 3 | 0.181 | 0.045 |

Control dye-donating elements were prepared in the same manner as dye-donating elements 1–3 except that Fluorad® FC-431, a nonionic fluorochemical surfactant (3M Company) was used in place of the fluoroalkyl acrylate copolymer of the invention. Details are given in Table 4.

TABLE 4

| Dye Donor Element | CAP Binder (g/m$^2$) | Release Agent (g/m$^2$) |
|---|---|---|
| C-1 | 0.226 | none |
| C-2 | 0.226 | FC-431 ® (0.003) |
| C-3 | 0.226 | FC-431 ® (0.011) |

Preparation of Dye-Receiving Element

The dye-receiving element was prepared by first extrusion laminating a paper core with a 38 μm thick microvoided composite film (OPPalyte® 350TW Mobil Chemical Co.) as disclosed in U.S. Pat. No. 5,244,861. The composite film side of the resulting laminate was then coated with the following layers in the order recited:

1) a subbing layer of Prosil® 221, an aminopropyltriethoxysilane, (PCR, Inc.) (0.05 g/m$^2$) and Prosil® 2210, an amino-functional epoxysilane, (PCR, Inc.) (0.05 g/m$^2$) coated from 3A alcohol; and
2) a dye-receiving layer composed of poly[isophthalic acid-co-5-sulfoisophthalic acid (90:10 molar ratio)-diethylene glycol (100 molar ratio)], Mw=20,000 (sulfonic acid of AQ29, Eastman Chemical Co.), (2.69 g/m$^2$), poly(butyl acrylate-co-allyl methacrylate) 98:2 wt core/ poly(glycidyl methacrylate) 10 wt shell (2.64 g/m$^2$), Dowfax® 2A1, anionic surfactant (Dow Chemical Company) (0.054 g/m$^2$), and Fluorad FC-170C®, a fluorocarbon surfactant (3M Company) (0.022 g/m$^2$), coated from distilled water.

Preparation of Thermal Dye Transfer Images

Eleven-step sensitometric thermal dye transfer images were prepared from the above dye-donating and dye-receiving elements. The dye side of the dye-donating element, approximately 10 cm×15 cm in area, was placed in contact with a receiving-layer side of a dye-receiving element of the same area. This assemblage was clamped to a stepper motor-driven, 60 mm diameter rubber roller. A thermal head (TDK model no. L-231, resolution of 5.4 dots/mm, thermostated at 25° C.) was pressed with a force of 24.4 Newton (2.5 kg) against the dye-donating element side of the assemblage, pushing it against the rubber roller.

The imaging electronics were activated causing the donor-receiver assemblage to be drawn through the print head/roller nip at 38.25 mm/sec. Coincidentally, the resistive elements in the print head were pulsed for 127.75 μs/pulse at 130.75 μs intervals during a 4.575 ms/dot printing cycle (including a 0.391 ms/dot cool-down interval). A stepped image density was generated by incrementally increasing the number of pulses/dot from a minimum of 0 to a maximum of 32 pulses/dot. The voltage supplied to the head was approximately 11.5 volts resulting in an instantaneous peak power of 0.266 watts/dot and a maximum total energy of 1.09 mJ/dot.

The dye-donating element was separated from the receiving element immediately upon exiting the printing nip. In some cases where donor-to-receiver sticking was observed, the donor could be removed from the print using adhesive tape to allow measurement of dye density in the print.

The dye-receiver after printing was held at 50° C. and relative humidity greater than or equal to 50% for 2 hrs. before density measurements were made. The densities of all steps including Dmax and an area receiving no thermal energy (Dmin) were measured using an X-Rite® 820 Reflection Densitometer (X-Rite Corp., Grandville, Mich.).

The results in terms of Status A red density are given in Table 5. These values were compared with the Status A red density observed in the receiver before printing (red density=0.05–0.06).

TABLE 5

| Dye Donor Element | Release Agent ($g/m^2$) | Print Dmax | Print Dmin | Donor-to-Receiver Sticking |
|---|---|---|---|---|
| 1 | A-1 (0.011) | 1.12 | 0.06 | none |
| 2 | A-1 (0.023) | 1.06 | 0.06 | none |
| 3 | A-1 (0.045) | 1.29 | 0.06 | none |
| C-1 | none | 1.36 | 0.07 | severe |
| C-2 | FC-431 ® (0.003) | 1.50 | 0.08 | severe |
| C-3 | FC-431 ® (0.011) | 1.64 | 0.10 | none |

The results in Table 5 show that the fluoroalkyl acrylate copolymer (A-1) of the invention is effective at preventing adhesion of dye-donor to dye-receiver without increasing the Dmin. Although FC-431® can be used to control donor-to-receiver sticking, an unacceptable increase in Dmin is observed even at low levels of this additive.

Example 2

Amount of Release Agent

Preparation of Dye-Donor Elements

Yellow dye-donor elements were prepared as described in Example 1 except the dye layer contained D-2 as described above (0.28 $g/m^2$) and binder compositions as given in Table 6 below:

TABLE 6

| Dye Donor Element | CAP Binder ($g/m^2$) | Release Agent ($g/m^2$) |
|---|---|---|
| 4 | 0.325 | A-1 (0.017) |
| 5 | 0.308 | A-1 (0.034) |
| 6 | 0.274 | A-1 (0.068) |
| 7 | 0.171 | A-1 (0.171) |
| 8 | 0.325 | A-2 (0.017) |
| 9 | 0.308 | A-2 (0.034) |
| 10 | 0.274 | A-2 (0.068) |
| 11 | 0.171 | A-2 (0.171) |

Control dye-donor elements were prepared in the same manner as dye-donor elements 4–11 except for the levels of release agents. Details are given in Table 7 below:

TABLE 7

| Dye Donor Element | CAP Binder ($g/m^2$) | Release Agent ($g/m^2$) |
|---|---|---|
| C-4 | 0 | A-1 (0.342)* |
| C-5 | 0 | A-2 (0.342)* |
| C-6 | 0.342 | none |

*Control since there is no other binder present

Preparation of Dye-Receiving Element

The dye-receiving element was prepared as described in Example 1 with the following dye-receiving layer:

a dye-receiving layer composed of poly[isophthalic acid-co-5-sulfoisophthalic acid (90:10 molar ratio)-diethylene glycol (100 molar ratio)], Mw=20,000 (sulfonic acid of AQ29, Eastman Chemical Co.), (2.69 $g/m^2$), poly(butyl acrylate-co-allyl methacrylate) 98:2 wt core/ poly(glycidyl methacrylate) 10 wt shell (3.95 $g/m^2$), Dowfax® 2A1, (0.081 $g/m^2$), and Fluorad FC-170C®, (0.022 $g/m^2$), coated from distilled water.

Preparation of Thermal Dye Transfer Images

Eleven-step sensitometric thermal dye transfer images were prepared as described in Example 1, except the voltage supplied to the head was approximately 12.0 volts resulting in an instantaneous peak power of 0.289 watts/dot and a maximum total energy of 1.18 mJ/dot.

The prints were analyzed for Status A blue density using an X-Rite® 820 Reflection Densitometer. The results are given in Table 8. These densities were compared with the 0.06–0.07 blue density observed in the receiver before printing. In several cases, the severe adhesion of donor to receiver prevented the removal of the donor for measurement of blue density.

TABLE 8

| Dye Donor Element | Release Agent ($g/m^2$) | Print Dmax | Print Dmin | Donor-to-Receiver Sticking |
|---|---|---|---|---|
| 4 | A-1 (0.017) | 1.26 | 0.06 | none |
| 5 | A-1 (0.034) | 1.34 | 0.06 | none |
| 6 | A-1 (0.068) | 1.41 | 0.07 | none |
| 7 | A-1 (0.171) | 1.60 | 0.06 | minor |
| C-4 | A-1 (0.342) | na | 0.07 | severe |
| 8 | A-2 (0.017) | 1.21 | 0.06 | none |
| 9 | A-2(0.034) | 1.11 | 0.06 | none |
| 10 | A-2(0.068) | 1.03 | 0.07 | none |
| 11 | A-2(0.171) | 0.86 | 0.06 | none |
| C-5 | A-2 (0.342) | na | 0.07 | severe |
| C-6 | none | 1.31 | 0.07 | severe |

When a donor is prepared with fluoroacrylate polymer alone (C-4 and C-5), severe sticking to the receiver is observed. When there is no release agent employed, severe sticking is also observed. When the release agent of the invention is employed, no or only minor sticking is observed.

Example 3

Different Binder

Preparation of Dye-Donor Elements

Dye-donor elements were prepared as described in Example 1 with the following dye layer composition:

D-1 (0.15 $g/m^2$), Butvar® B-76, a poly(vinyl butyral), (Monsanto Chemical Company) (0.181 $g/m^2$), and the fluoroacrylate copolymer A-3 (0.045 $g/m^2$).

Control dye-donor elements were prepared in the same manner with D-1 (0.15 $g/m^2$), Butvar B-76®, (0.226 $g/m^2$), and, Fluorad® FC-431 or FC-430 as the release agent. The laydowns for the donor compositions are given in Table 9

TABLE 9

| Dye Donor Element | Butvar ® ($g/m^2$) | Release Agent ($g/m^2$) |
|---|---|---|
| 12 | 0.181 | A-3 (0.045) |
| C-7 | 0.226 | none |
| C-8 | 0.226 | FC-431 ® (0.003) |
| C-9 | 0.226 | FC-430 ® (0.003) |

Preparation of Dye-Receiving Element

The dye-receiving element was prepared as described in Example 1 with the following dye-receiving layer:

a dye-receiving layer composed of poly[isophthalic acid-co-5-sulfoisophthalic acid (90:10 molar ratio)-diethylene glycol (100 molar ratio)], Mw=20,000 (sulfonic acid of AQ29, Eastman Chemical Co.), (2.36 $g/m^2$), poly(butyl acrylate-co-allyl methacrylate) 98:2 wt core/ poly(glycidyl methacrylate) 10 wt shell (2.31 g/m$^2$), Dowfax ®2A1 (0.047 g/m$^2$), succinic acid (0.097 g/m$^2$), Snowtex® ST-O, colloidal silica particles (Nissan Chemical Company) (1.076 g/m$^2$) coated from distilled water.

Preparation of Thermal Dye Transfer Images

Eleven-step sensitometric thermal dye transfer images were prepared as described in Example 2.

The prints were analyzed for Status A red density using an X-Rite® 820 Reflection Densitometer. The results are given in Table 10. These densities were compared with the 0.06 Status A red density observed in the receiver before printing. In the absence of a release agent, the severe adhesion of donor to receiver prevented the removal of the donor for measurement of red density.

TABLE 10

| Dye Donor Element | Release Agent (g/m$^2$) | Print Dmax | Print Dmin | Donor-to-Receiver Sticking |
|---|---|---|---|---|
| 12 | A-3 (0.045) | 2.25 | 0.06 | none |
| C-7 | none | na | 0.06 | severe |
| C-8 | FC-431 ® (0.003) | 2.04 | 0.08 | none |
| C-9 | FC-430 ® (0.003) | 2.07 | 0.09 | none |

The above results show that the fluoroalkyl acrylate copolymer of the invention is an effective release agent for Butvar®-based dye-donor elements, without raising Dmin, as compared to controls using a nonionic fluorochemical surfactant of the prior art.

Example 4

Release Agents of the Invention

Preparation of Dye-Donor Elements

Dye-donor elements were prepared as described in Example 1 with the following dye layer composition:

Dye D-1 (0.15 g/m$^2$), Paphen® Phenoxy Resin PKHJ®, a bisphenol A epichlorohydrin polymer, (Phenoxy Associates) (0.181 g/m$^2$), and a fluoroalkyl acrylate copolymer listed below (0.045 g/m$^2$).

TABLE 11

| Dye-Donor Element | Release Agent |
|---|---|
| 13 | A-1 |
| 14 | A-3 |
| 15 | A-4 |
| C-10 | none |

Preparation of Dye-Receiving Element

The dye-receiving element was prepared as described in Example 3.

Preparation of Thermal Dye Transfer Images

Eleven-step sensitometric thermal dye transfer images were prepared and evaluated as described in Example 2. The results are given in Table 12. The Status A red densities were compared with the 0.04 Status A red density observed in the receiver before printing.

TABLE 12

| Dye Donor Element | Release Agent | Print Dmax | Print Dmin | Donor-to-Receiver Sticking |
|---|---|---|---|---|
| 13 | A-1 | 1.88 | 0.04 | none |
| 14 | A-3 | 1.99 | 0.04 | none |
| 15 | A-4 | 1.96 | 0.04 | none |
| C-10 | none | 1.88 | 0.04 | severe |

The results in Table 12 show that copolymers of the invention with a range of fluoroalkyl acrylate monomer levels (15–50 wt %) are effective in reducing dye-donor to dye-receiver sticking.

Example 5

Comparison with Low Molecular Weight Control

Preparation of Dye-Donor Elements

A dye donor binder, B-1, was prepared by making the propionate ester of Paphen® Phenoxy Resin PKHJ® using techniques similar to those described in U.S. Pat. No. 5,244,862.

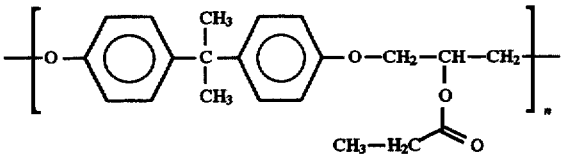

Propionated phenoxy resin #1
Dye Binder Polymer B-1

Dye-donor elements were prepared as described in Example 1 with the following dye layer composition:

D-1 (0.15 g/m$^2$), binder polymer B-1, and the release agents described in Table 13.

Control dye-donor elements were similarly prepared containing Fluorad® FC-431 and Zonyl® FSO-100, a long-chain, fluorine-containing alcohol (DuPont), non-acrylate material. Zonyl® FSO-100 is defined as $F(CF_2CF_2)_{3-8}$—$CH_2CH_2$—O—$(CH_2CH_2O)_n$—OH.

TABLE 13

| Dye-Donor Element | B-1 Binder Level (g/m$^2$) | Release Agent (g/m$^2$) |
|---|---|---|
| 16 | 0.181 | A-3 (0.045) |
| 17 | 0.226 | A-3 (0.045) |
| C-11 | 0.226 | FC-431 ® (0.002) |
| C-12 | 0.226 | FC-431 ® (0.011) |
| C-13 | 0.226 | FSO-100 ® (0.002) |
| C-14 | 0.226 | FSO-100 ® (0.011) |
| C-15 | 0.226 | none |

Preparation of Dye-Receiving Element

The dye-receiving element was prepared as described in Example 3.

Preparation of Thermal Dye Transfer Images

Eleven-step sensitometric thermal dye transfer images were prepared and evaluated as described in Example 2. The results are given in Table 14. The Status A red densities were compared with the 0.04 Status A red density observed in the receiver before printing.

TABLE 14

| Dye-Donor Element | Release Agent ($g/m^2$) | Print Dmax | Print Dmin | Donor-to-Receiver Sticking |
|---|---|---|---|---|
| 17 | A-3 (0.045) | 2.45 | 0.04 | none |
| 18 | A-3 (0.045) | 2.40 | 0.04 | none |
| C-11 | FC-431 ® (0.002) | 2.42 | 0.14 | none |
| C-12 | FC-431 ® (0.011) | 2.54 | 0.20 | none |
| C-13 | FSO-100 ® (0.002) | 2.10 | 0.09 | minor |
| C-14 | FSO-100 ® (0.011) | na | 0.11 | severe |
| C-15 | none | 2.12 | 0.06 | severe |

The above results show that the control materials (C-11 to C-14) containing fluoroalkyl groups are ineffective in relieving donor-to-receiver sticking without increasing Dmin to objectionable levels, in comparison to the dye-donor element of the invention (17 and 18).

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye layer comprising an image dye in a polymeric binder, said dye layer also containing a release agent comprising a copolymer having the following formula:

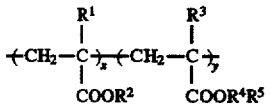

wherein $R^1$ and $R^3$ each independently represents hydrogen or methyl;

$R^2$ represents a substituted or unsubstituted alkyl group of from 1 to about 6 carbon atoms;

$R^4$ represents a divalent bridging group having from 1 to about 16 carbon atoms;

$R^5$ represents a haloalkyl group having from about 3 to about 20 carbon atoms, wherein the halogen consists essentially of fluorine;

x represents 25–95 weight percent; and y represents 5–75 weight percent.

2. The element of claim 1 wherein said x represents 50–90 weight percent and y represents 10–50 weight percent.

3. The element of claim 1 wherein said release agent is present at a concentration of from about 2 to about 40% by weight of said dye layer.

4. The element of claim 1 wherein $R^1$ and $R^3$ each represent methyl.

5. The element of claim 1 wherein $R^2$ represents butyl, and $R^4$ represents ethylene.

6. The element of claim 1 wherein $R^5$ represents a perfluoro group having from 6 to 12 carbon atoms.

7. The element of claim 1 wherein the opposite side of said support having thereon said dye layer has a slipping layer thereon.

8. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye layer also contains a release agent comprising a copolymer having the following formula:

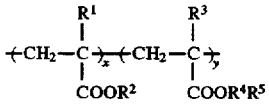

wherein $R^1$ and $R^3$ each independently represents hydrogen or methyl;

$R^2$ represents a substituted or unsubstituted alkyl group of from 1 to about 6 carbon atoms;

$R^4$ represents a divalent bridging group having from 1 to about 16 carbon atoms;

$R^5$ represents a haloalkyl group having from about 3 to about 20 carbon atoms, wherein the halogen consists essentially of fluorine;

x represents 25–95 weight percent; and y represents 5–75 weight percent.

9. The process of claim 8 wherein said x represents 50–90 weight percent and y represents 10–50 weight percent.

10. The process of claim 8 wherein said release agent is present at a concentration of from about 2 to about 40% by weight of said dye layer.

11. The process of claim 8 wherein $R^1$ and $R^3$ each represent methyl.

12. The process of claim 8 wherein $R^2$ represents butyl, and $R^4$ represents ethylene.

13. The process of claim 8 wherein $R^5$ represents a perfluoro group having from 6 to 12 carbon atoms.

14. A thermal dye transfer assemblage comprising:

a) a dye-donor element comprising a support having thereon a dye layer comprising an image dye dispersed in a polymeric binder, and b) a dye-receiving element comprising a support having thereon a dye image-receiving layer, said dye-receiving element being in superposed relationship with said dye-donor element so that said dye layer is in contact with said dye image-receiving layer, wherein said dye layer also contains a release agent comprising a copolymer having the following formula:

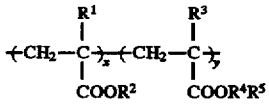

wherein $R^1$ $R^3$ each independently represents hydrogen or methyl;

$R^2$ represents a substituted or unsubstituted alkyl group of from 1 to about 6 carbon atoms;

$R^4$ represents a divalent bridging group having from 1 to about 16 carbon atoms;

$R^5$ represents a haloalkyl group having from about 3 to about 20 carbon atoms, wherein the halogen consists essentially of fluorine;

x represents 25–95 weight percent; and y represents 5–75 weight percent.

15. The assemblage of claim 14 wherein said x represents 50–90 weight percent and y represents 10–50 weight percent.

16. The assemblage of claim 14 wherein said release agent is present at a concentration of from about 2 to about 40% by weight of said dye layer.

17. The assemblage of claim 14 wherein $R^1$ and $R^3$ each represent methyl.

18. The assemblage of claim 14 wherein $R^2$ represents butyl, and $R^4$ represents ethylene.

19. The assemblage of claim 14 wherein $R^5$ represents a perfluoro group having from 6 to 12 carbon atoms.

* * * * *